US008893986B2

(12) United States Patent
Kah, Jr. et al.

(10) Patent No.: US 8,893,986 B2
(45) **Date of Patent: *Nov. 25, 2014**

(54) SPRAY NOZZLE WITH ADJUSTABLE ARC SPRAY ELEVATION ANGLE AND FLOW

(76) Inventors: Carl L. C. Kah, Jr., North Palm Beach, FL (US); Carl L. C. Kah, III, North Palm Beach, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/247,593

(22) Filed: Sep. 28, 2011

(65) Prior Publication Data

US 2012/0012670 A1 Jan. 19, 2012

Related U.S. Application Data

(60) Division of application No. 11/760,167, filed on Jun. 8, 2007, now Pat. No. 8,047,456, which is a division of application No. 11/053,567, filed on Feb. 7, 2005, now Pat. No. 7,232,081, which is a continuation of application No. 10/100,259, filed on Mar. 15, 2002, now abandoned.

(60) Provisional application No. 60/275,632, filed on Mar. 15, 2001.

(51) Int. Cl.

| | |
|---|---|
| ***B05B 1/26*** | (2006.01) |
| ***B05B 1/32*** | (2006.01) |
| *B05B 1/30* | (2006.01) |

(52) U.S. Cl.

CPC . *B05B 1/262* (2013.01); *B05B 1/30* (2013.01); *B05B 1/267* (2013.01); *Y10S 239/01* (2013.01)

USPC ..... 239/514; 239/457; 239/518; 239/519; 239/DIG. 1

(58) Field of Classification Search

CPC ..... B05B 1/12; B05B 1/26; B05B 1/262; B05B 1/265; B05B 1/267; B05B 1/30; B05B 1/3033; B05B 1/3073; B05B 1/32

USPC ..... 239/73, 200, 201, 396, 451, 456, 457, 239/460, 505, 506, 511–515, 538, 539, 239/600–602, DIG. 1, 518–520, 524

See application file for complete search history.

(56) References Cited

U.S. PATENT DOCUMENTS

| | | | | |
|---|---|---|---|---|
| 4,579,285 A * | 4/1986 | Hunter | ..... | 239/457 |
| 5,031,840 A * | 7/1991 | Grundy et al. | ..... | 239/456 |
| 5,205,491 A * | 4/1993 | Hadar | ..... | 239/457 |
| 5,556,036 A * | 9/1996 | Chase | ..... | 239/457 |
| 6,769,633 B1 * | 8/2004 | Huang | ..... | 239/457 |

* cited by examiner

*Primary Examiner* — Darren W Gorman
(74) *Attorney, Agent, or Firm* — Ostrolenk Faber LLP

(57) ABSTRACT

An adjustable spray nozzle with adjustable arc of coverage as well as spray elevation angle and flow rate. A very simple adjustable arc of coverage spray nozzle configuration is also disclosed which may be easily assembled for a particular precipitation rate and/or range of coverage at a selected nominal pressure. Also disclosed is a simple fixed arc of coverage spray nozzle with selectable ranges for a particular precipitation rate.

9 Claims, 9 Drawing Sheets

SPRAY NOZZLE WITH ADJUSTABLE ARC SPRAY ELEVATION ANGLE AND FLOW

RELATED APPLICATION

The present application is a division of prior application Ser. No. 11/760,167, filed Jun. 8, 2007, now allowed, by Carl L. C. Kah, Jr. and Carl L. C. Kah, III entitled Spray Nozzle with Adjustable Arc Spray Elevation Angle and Flow, which is a division of Ser. No. 11/053,567, now issued, filed Feb. 7, 2005, by Carl L. C. Kah, Jr. and Carl L. C. Kah, III entitled Spray Nozzle with Adjustable Arc Spray Elevation Angle and Flow, which is a continuation of prior application Ser. No. 10/100,259, filed Mar. 15, 2002, now abandoned, by Carl L. Kah, Jr. and Carl L. Kah, III entitled Spray Nozzle with Adjustable Arc Spray Elevation Angle and Flow, which is a non-provisional of U.S. Provisional Application Ser. No. 60/275,632, filed Mar. 15, 2001, entitled Spray Nozzle With Adjustable Arc Spray Elevation Angle and Flow.

BACKGROUND OF THE INVENTION

1. Technical Field

The present invention relates to sprinkler systems, and more particularly, to adjustable arc of coverage sprinkler nozzles in which spray elevation and flow are also adjustable to provide a water spray precipitation over a settable area of coverage.

2. Related Art

U.S. Pat. Nos. 5,148,990 and 5,588,594 disclose adjustable arc of coverage spray nozzle sprinklers and related prior art. When using such sprinklers as part of an in-ground sprinkler system, it is necessary during setup to adjust the arc of coverage, as well as the stream angle of the nozzle to provide uniform coverage. Also, as noted in U.S. Pat. No. 5,588,594, the disclosure of which is incorporated herein as if fully set forth, it is necessary to adjust the flow rate when changing the stream angle.

Presently, a nozzle having a preset stream angle is required to achieve a desired spray range such as 8 ft., 10 ft., 12 ft., 15 ft. and 17 ft. For nozzles having a fixed arc of coverage, e.g., quarter-circle, half-circle, three-quarter-circle and full circle coverage, separate spray nozzles are required for each range to provide approximately matched precipitation rates for sprinklers operating on the same watering zone with the same run time interval.

Adjustable spray nozzles of the type disclosed in U.S. Pat. No. 5,588,594 are designed specifically to provide matched precipitation for each group of different ranges. This allows use of only one nozzle for each range instead of four for each range.

Nevertheless, to achieve multiple ranges, multiple nozzles are still needed. There are no spray nozzle sprinklers commercially available which provide both adjustable spray angle and arc of coverage. A need clearly exists for a spray nozzle in which the stream elevation angle, and the arc of coverage (as well as the flow rate) are all adjustable, thereby permitting use of one manufactured nozzle configuration rather than between 5 and 15 different spray nozzles which are now required to be carried and available on an irrigation job for a matched precipitation rate system.

Similarly, there are no commercially available spray nozzle sprinklers in which the flow rate automatically adjusts as the spray elevation angle is changed to maintain a substantially constant precipitation rate.

Despite the lack of variable spray elevation angle capability, an adjustable arc sprinkler constructed in accordance with U.S. Pat. No. 5,588,594 has many advantages, but it would also be desirable to be able to provide similar features in a product which has a simpler design, and is less costly to manufacture.

SUMMARY OF THE INVENTION

It is accordingly an object of the present invention to provide a spray nozzle in which the stream elevation angle, and the arc of coverage are both adjustable, and in which the flow rate is automatically adjusted to maintain a substantially constant precipitation rate.

It is also an object of this invention to provide a spray nozzle which has a simple design, and inexpensive and easy to manufacture.

According to a first aspect of the invention, there is provided an adjustable arc spray nozzle assembly comprising a fixed housing defining a passage with an inlet for attachment to a source of pressurized water and an outlet defined by a spiraled edge for dispensing water, a rotationally and axially moveable arc setting member that cooperates with the spiraled edge of the outlet to define an adjustable arcuate dispensing orifice, the axial movement of the arc setting member being controlled relative to the rotational movement thereof by axial displacement of a camming surface.

Further according to the first aspect of the invention, the moveable member is rotationally axially supported and is mechanically held in the housing by snap lips.

According to a second aspect of the invention, there is provided an adjustable spray angle nozzle assembly comprising a fixed housing defining a passage having an inlet for attachment to a source of pressurized water and having an outlet for dispensing water radially outward, and an adjustable flow control element including an adjustable spray angle deflector that determines the angle of elevation of the water exiting from the outlet, and also adjusts the flow rate.

In the adjustable spray nozzle according to the second aspect of the invention, the deflector is formed of a flexible material and is mechanically adjustable to vary the slope angle which determines the angle of elevation of the exiting water.

Also according to the second aspect of the invention, the flow rate adjustment takes place upstream of the dispensing outlet.

According to the a third aspect of the invention, the mechanism that adjusts the spray elevation angle also operates an adjustable flow area valve member upstream of the sprinkler exit orifice.

According to a fourth aspect of the invention, there is provided an adjustable spray nozzle assembly comprising a housing having an inlet attachable to a source of pressurized water and an outlet defined by a spiraled edge for dispensing a stream of water, a flow control element including a moveable spray arc setting member that cooperates with the spiraled edge of the housing, and is rotationally and axially movable to define an adjustable arcuate dispensing orifice, and a spray deflector in the path of the stream of water that is movable to adjust the elevation angle of the stream, a valve upstream of the outlet, and a mechanism coupled to the flow control element and the valve which adjusts the valve when the spray deflector is adjusted to maintain a substantially constant precipitation rate for different spray elevation angles.

According to a fifth aspect of the invention, there is provided an adjustable spray nozzle assembly comprising a housing having an inlet attachable to a source of pressurized water and an outlet for dispensing a stream of water, a flow control element including a moveable spray elevation angle setting member in the path of the stream of water that is rotationally and axially movable to adjust the elevation angle of the stream, a valve upstream of the outlet; and a mechanism coupled to the flow control element and the valve which adjusts the valve when the spray deflector is adjusted to maintain a substantially constant precipitation rate for different spray elevation angles.

In a sprinkler nozzle according to several aspects of this invention, the spray elevation angle can be adjusted by deflecting a simple flexible spray deflector piece. The flow rate can then be separately adjusted or varied in combination with the adjustment of the spray angle flexible deflector.

In some configurations adjusting the spray deflector for a lesser spray angle also closes down the spray nozzle's flow area.

Also, in a sprinkler nozzle according to several aspects of this invention, the mechanism for adjusting the angle of the deflector plate is linked to a separate upstream flow control valve. Thus as the spray elevation angle and range are varied, the flow rate changes correspondingly to better maintain a uniform amount of water per unit of area covered.

Being able to adjust range with spray elevation angle allows the up stream flow throttling valve to be used to reduce water flow or increase water flow to adjust precipitation rate requirements separate from range control for a single spray nozzle.

Other features and advantages of the present invention will become apparent from the following description of the invention which refers to the accompanying drawings.

DETAILED DESCRIPTION OF THE PREFERRED EMBODIMENTS

Figure 1:
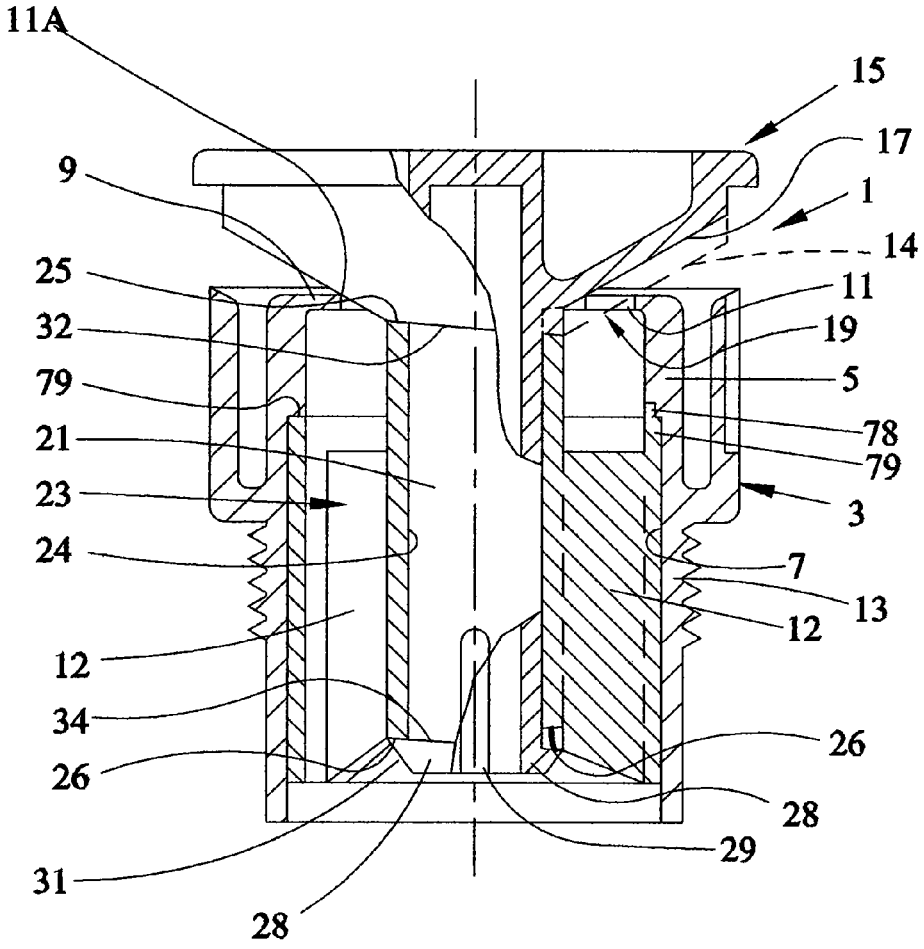
FIG. 1 is a side elevation view of an adjustable arc of coverage spray nozzle in which the cylindrical housing and the adjustable arc angle setting element are shown in partial cross-section.
Figure 2A:
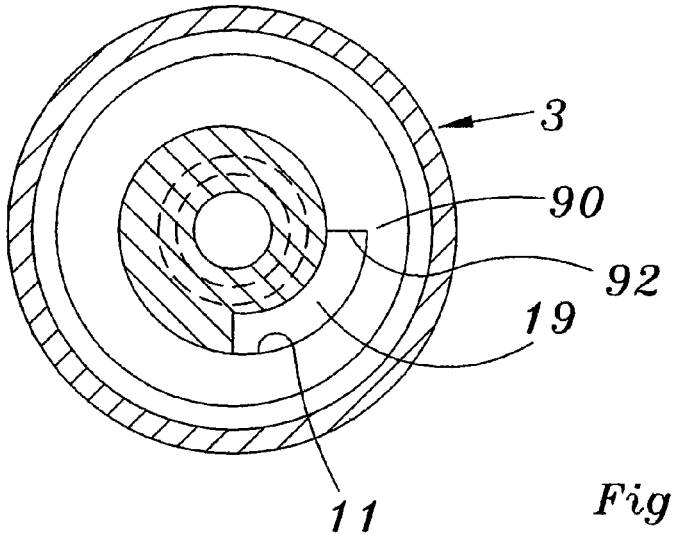
FIG. 2A is a top sectional view of the spray nozzle housing and the flow control element taken along line 2A-2A in FIG. 2B.
Figure 2B:
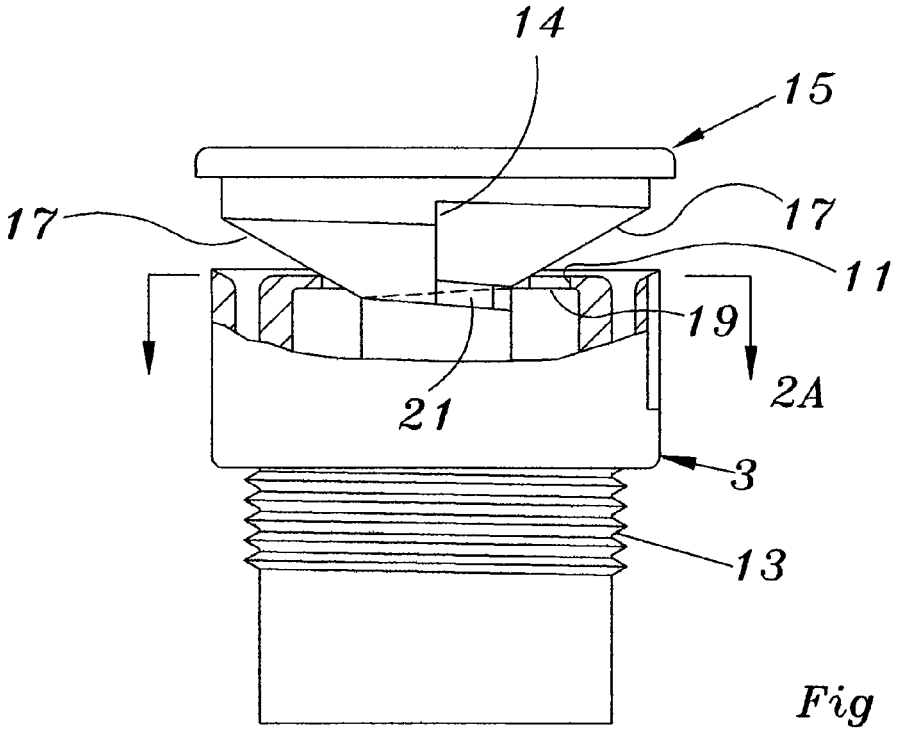
FIG. 2B is a partially sectioned side elevation view in matching position to FIG. 2A showing a partially sectioned housing and arc set flow deflector member.

FIGS. 1, 2A, and 2B illustrate a basic spray nozzle assembly 1 with an adjustable arc of coverage. This is formed of three main parts; a cylindrical housing 3, a body insert 23, and a spray flow control element 15 which provides combined arc of coverage setting, and flow rate control, and also serves as a deflector to determine the spray elevation angle, and consequently, the spray range.

Cylindrical housing 3 is formed of an outer circular wall 5, having an inner surface 7 and an outlet end closure top wall 9 with a radially spiraled outlet opening, or hole, 11 therethrough. Body insert 23 is supported by an axially extending ribbed support structure 12 that can be integrally molded with housing 3or inserted as a separate part. Housing 3 includes a threaded skirt 13 that extends downwardly for attachment to the underground supply lines (not shown) for pressurized water.

As illustrated in FIG. 1, housing insert 23 is not integral with housing 3. To prevent housing insert 23 from rotating, there is provided a keying rib 78. A step 79 in the inside of housing 3 engages with rib 78 to prevent vertical movement.

Spray flow control element 15 has a sloped axially spiraled surface 17 which cooperates with the radially spiraled housing outlet hole 11 to provide a sealable arcuate exit opening 19, the angle of which may be varied from approximately zero to 360 degrees by the rotation of flow control element 15.

As illustrated in FIGS. 1, 2A and 2B, flow control element 15 is mounted on the top of the housing 3 with the sloped axially spiraled surface 17 protruding downwardly into radially spiraled housing outlet opening 11. Thus, the rotational position of flow control and deflector element 15 adjustably closes and opens spiraled opening 11, which establishes the size of exit opening 19, and consequently determines the arc of coverage of the sprinkler. As will be appreciated, the angle at which the spray exits from opening 19, and therefore the spray ranges are determined by the slope angle of surface 17.

Flow control and deflector element 15 is held in axial alignment within cylindrical housing 3 by an integral hollow shaft 21 extending downwardly into a tubular portion 24 of insert 23, which serves as an axial bearing for shaft 21.

The portions of insert 23 extending from the upper and lower margins 25 and 26 of tubular portion 24 are formed as matched spirals, and serve as cam tracks for axially positioning flow control element 15 as it rotates. To this end, a displacement surface 32 at the upper end of shaft 21, and a displacement surface 34 at the lower end of shaft 21 bear respectively against cam tracks 25 and 26, and therefore serve as cam followers. As illustrated cam tracks 25 and 26 are spiraled so flow control element 15 rises as it rotates in the clockwise direction as shown in FIG. 1.

Flow control element 15 in the configuration of FIG. 1 must be held downwardly against the edge 11A of outlet opening 11 against the water pressure in housing 3. This is accomplished by the snap lips 28 formed on the lower end of the shaft 21. To permit assembly, a longitudinal slit 29 and a tapered portion 31 at the bottom of shaft 21 allows resilient radially inward displacement of lips 28 when shaft 21 is inserted downwardly through center tube 24 in housing insert 23.

The uniquely simple action of the basic adjustable arc of coverage spray nozzle assembly 1 is as follows for a functional spray sprinkler. Other angles and slots sizes may be selected.

In a typical configuration as shown in FIG. 1, flow control element 15 is axially displaced upwardly by cam surface 25 on the upper side of the housing insert 23 during rotation from a fully closed to approximately a 360 degree angle and held down against pressure forces by cam surface 26 on the lower side of housing insert 23.

The axially displaced surface 17 of the flow control element 15 rides around edge 11A of the radially spiraled housing outlet opening 11 to the smaller radial diameter of the spiraled housing outlet hole 11 maintaining a shut off contact with that edge as flow control element 15 is rotated and axially displaced upwardly. The upwardly displaced end position of the deflector surface 17 is rotated over the uncovered larger diameter portion of the radially displaced spiral opening 11. The arcuate flow opening 19 is thus established between the deflector surface 17 and the uncovered radial spiral edge 11A. The angle of surface 17 off the horizontal provides the spray angle at the exit diameter of the flow control element 15. The height of the surface 17 off of the edge determines the flow exit area.

Thus, the arcuate opening height which is provided by the interaction of a radially spiraled housing outlet hole 11 and a sloped axially spiraled surface is a geometric result of the size of the step 14 of the spiral between its ends 90 and 92 (See FIGS. 2A and 2B), and the slope angle of the axially spiraled surface 17 which also serves as the spray deflector in the configuration shown in FIG. 1. This is selected to provide the desired range characteristics for the spray nozzle assembly. A slope angle of approximately 25-30 degrees is a desirable spray angle for good range in air. Further details concerning the operative interaction between surface 17 and slot 11 may be found in U.S. Pat. No. 5,588,594.

Other desired spray angle and flow rates for spray nozzle 1 may be provided simply by snapping in a different flow control element 15 to provide different ranges of coverage. This may be done by depressing lips 28 inwardly (as permitted by slot 29) so that shaft 21 can pass back through hole 24 in insert 23. The exit angle of the deflector surface 17 at its outer edge may be made different than at the valving radius.

The spray nozzle may be easily cleaned by snapping out the flow control element 15, which may be molded in different colors if desired to allow quick identification of range or precipitation rate for the resulting spray nozzle sprinkler. Alternatively, housing 3 may be molded in different colors for easy identification. These different expected performance of range, flow rate and precipitation rate for a particular flow control element 15 can also be printed on the top surface of the flow control element 15.

Figure 3:
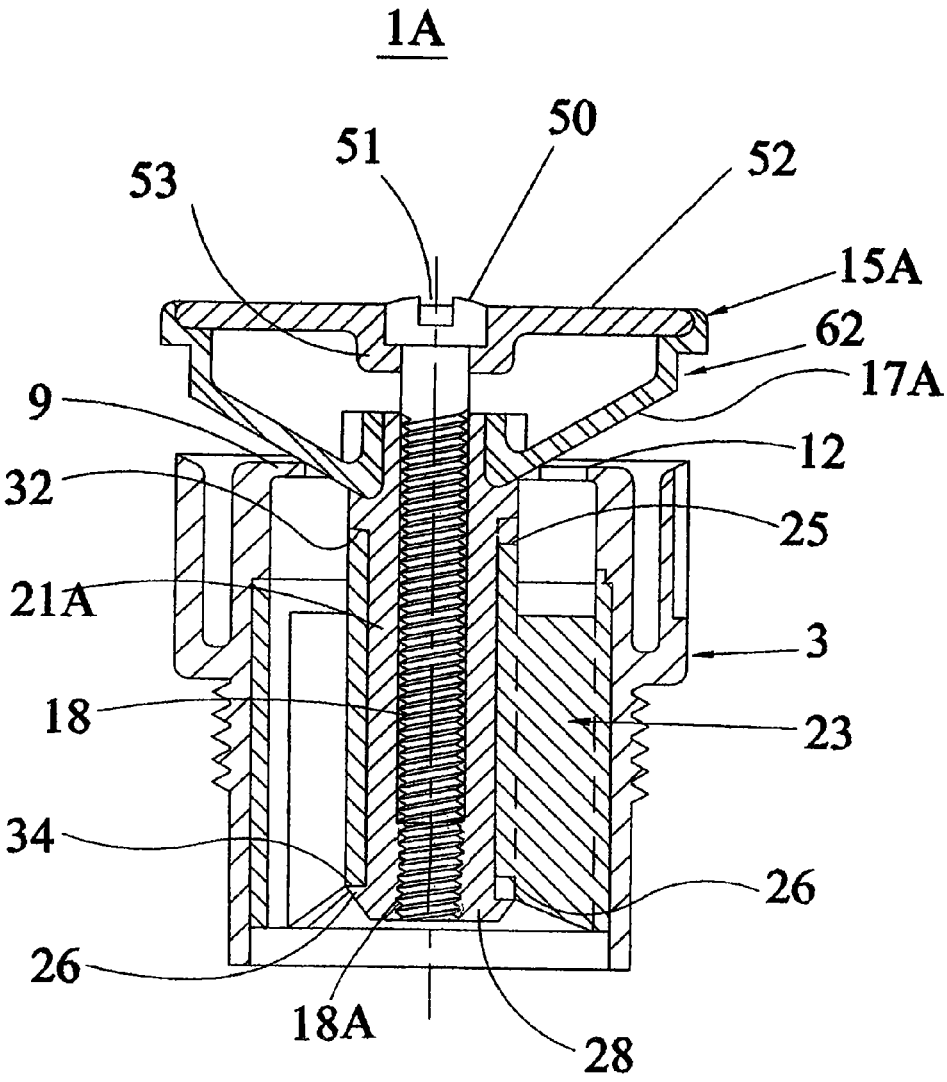
FIG. 3 is a side elevation view shown in cross section of an adjustable arc of coverage spray nozzle assembly with a flexible adjustable spray elevation angle deflector.
Figure 4:
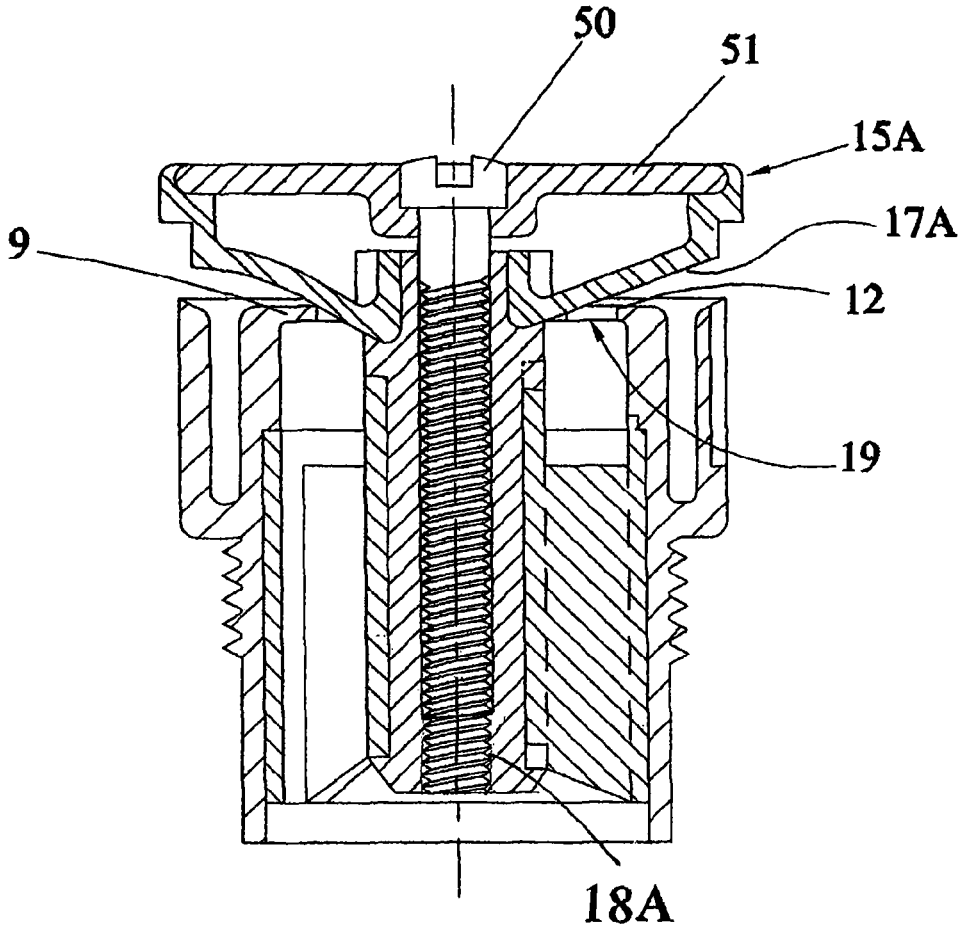
FIG. 4 is the same adjustable spray nozzle assembly shown in FIG. 3 with the flexible spray elevation angle deflector adjusted for a lower spray angle.

FIGS. 3 and 4 illustrate a spray nozzle assembly, generally denoted at 1A, having a flow control element which permits both spray elevation angle and arc of coverage adjustment. As shown in FIG. 3, a modified flow control element 15A includes a top plate 52 and a relatively thin and flexible cone-shaped body portion 62, the outer face of which forms a deflector surface 17A. This is adjustable to alter the spray elevation angle. The body portion 62 of flow control element 15A can be manufactured by insert molding, co-molding or assembly from two separate parts, or in any other suitable manner.

Adjustability of the deflection angle with flow control element 15A is accomplished by a threaded control rod 18 having a slotted head 50. The bottom of head 50 bears against a collar 53 on top plate 52. Threaded rod 18 engages with internal threads 18A in a bore in a hollow shaft 21A. When rod 18 is rotated e.g., by a screwdriver inserted in slot 51 in head 52, so it moves down into hollow shaft 21A, top plate 52 pushes the outer circumference of flow control element body 62 downwardly. As illustrated in FIG. 4, this distorts the shape of deflector 17A and reduces the spray exit angle relative to the ground, and consequently, the spray range.

Also, deflector surface 17A moves closer to the spray flow opening 19, which closes down the spray flow area formed between cylindrical housing top surface 20 and spray deflector surface 17A to reduce the flow area, and consequently, the flow rate. By reducing the flow for lower spray ranges, a more uniform precipitation rate for spray nozzles on the same zone is achieved. The flexible deflector wall thickness may be adjusted to give approximately the correct flow as the spray exist angle is reduced.

In FIG. 4 on the left side, the flexible deflector surface 17A is against the spiral surface 11 where the arcuate flow area has not yet been opened for adjusting the arc of coverage. It can be seen that the flexibility of the deflector can allow it to bend to accommodate the valving edge engagement while allowing it to reduce the flow exit area due to its reduced exit angle, as shown on the open right side.

As in the case of the embodiment illustrated in FIGS. 1, 2A, and 2B, the lower spiral surface 34 on shaft 21 bears on cam surface 26 on housing insert 23 to hold flow control element 15A in place within the nozzle housing 3. Also, as in the embodiment of FIGS. 1, 2A, and 2B, spiral surface 32 surrounding the top of shaft 21 must be matched to the lower spiral surface 34 to allow flow control element 15A to rise and be held in place by the housing insert 23 cooperating spiral surfaces 25 and 26 as it is rotated. The axial movement of the deflector is shown being controlled by these camming surfaces as a possible attractive low cost manufacturing method. However, other methods may be used, such as threading deflector shaft 21 at the proper pitch, and mounting it in hole 24 in insert 23.

Figure 5:
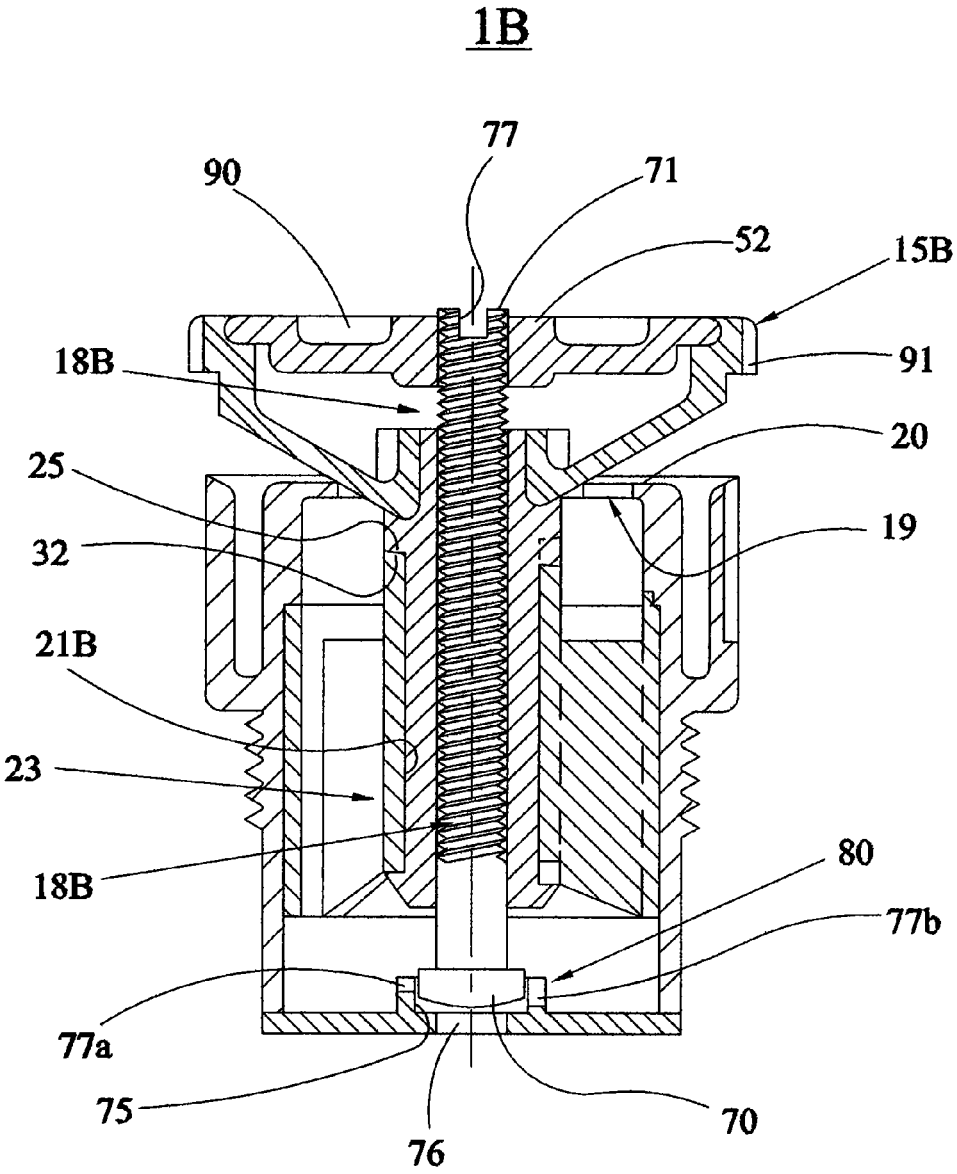
FIG. 5 is a side elevation view shown in cross section of an adjustable arc and spray elevation angle nozzle assembly with an additional upstream separately controllable flow throttling valve.

FIG. 5 illustrates a nozzle, generally denoted at 1B, which is similar to that of FIGS. 3 and 4, except that it also includes a centered flow throttling valve upstream of the spray flow discharge opening. Nozzle 1B includes an internally threaded shaft 21B. A rod 18 is threaded into shaft 21B and also into an internally threaded bore 64 in a top plate 52 of a flow control element 15B.

The flow reducing valve, generally denoted at 80, is comprised of a valve body 75 and a closure element 70 which may be formed by a head on control rod 18B, and which fits into valve body 75. Water enters through an inlet opening 76 at the bottom of body insert 23 and exits through an array of slots 77 positioned around valve body 75. Six to eight slots may be provided.

As illustrated in FIG. 5, slot 77*a* on the left side of the figure is shorter than slot 77b on the right side. The other slots are of intermediate size. Moreover, the slots are advantageously V-shaped. As explained below, the indicated configuration provides a net flow area which varies as a function of both the arc angle and the spray elevation angle.

A slot 71 at the top of threaded shaft 18B accommodates a screw driver or the like to permit rotations of the shaft. This raises and lowers valve closure element 70 and increases or decreases the flow area of outlet slots 77.

Throttling valve 80 may be separately adjusted from the top plate 52 using a flow control slot 71 while holding the outside circumference of flow control element 15B from rotating by ribs or serrations 91. Thus, the axial position of valve closure element will vary in relation to both the arc angle and the spray elevation angle. By selecting the number, size and shape of outlet slots 77, the upstream flow area may be adjusted to provide the flow required for the different arc and elevation settings.

As in the case of the embodiment of FIGS. 3 and 4, the deflector spray angle is adjusted due to the action of top plate 52 pressing down on the outer edge of the flow control element 15B as the top plate is rotated e.g., by use of slots 90. The friction between the threads on shaft 18 and the internally threaded bore 64 in top plate 52 is made sufficient that control rod 18B moves with top plate 52 as the plate is rotated relative to the rest of flow control element 15B. Thus, the valve closure element 70 is moved up or down relative to flow control element 15B, which results in the simultaneous adjustment of the spray angle and the flow rate, to maintain a more constant precipitation rate as the range of coverage is adjusted by varying the deflection angle. Valve 80 can be pre-set at the factory, but can also be adjusted in the field by using a screw driver or the like to turn flow control slot 71 at the top of control rod 18B. As will be understood, rotating only the shaft 18 while holding the cofer with slots 90 will cause cover 52 to move up or down on control rod 18 to adjust the spray angle alone without any effect on upstream flow area at valve 80.

Figure 6:
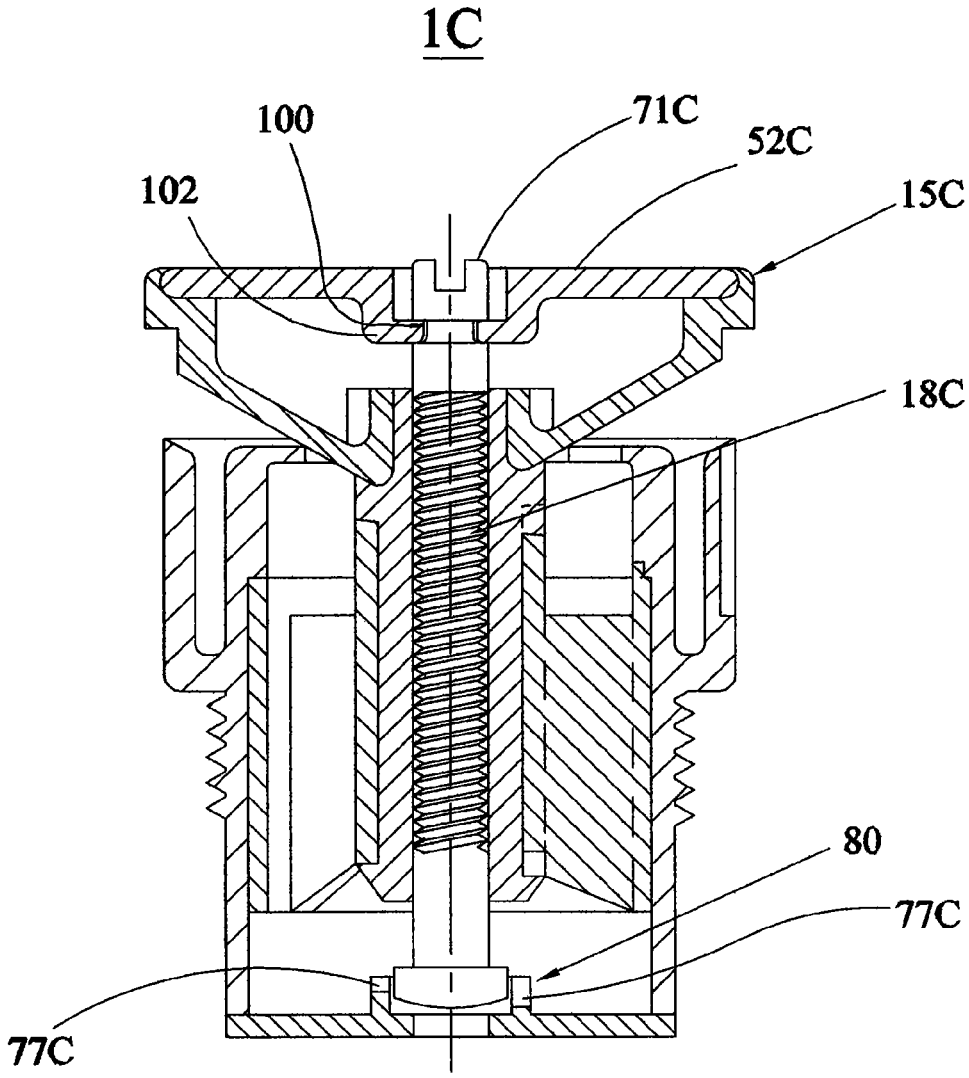
FIG. 6 is a side elevation view shown in cross section of another adjustable arc spray nozzle assembly with an upstream throttling valve mechanically linked to the stream elevation angle adjusting mechanism.

FIG. 6 illustrates another nozzle, generally denoted at 1C, in which the spray angle is adjusted by rotation of a screw mechanism. As illustrated, a groove 100 formed in a threaded control rod 18C is rotatably fitted into a collar 102 in a top plate 52C of a flow control element 15C. When control rod 18C is rotated by a suitable tool inserted into top slot 71C, it moves up or down as previously described, and the radial walls of groove 100 bear on collar 102 so that top plate 52C also moves up or down. As described in connection with FIGS. 3 and 4, this changes the angle of the deflector element 17C, thereby adjusting the spray angle and range of coverage.

As in the embodiment of FIG. 5, rotation of control rod 18C operates valve 80 to control the flow rate.

Figure 7B:
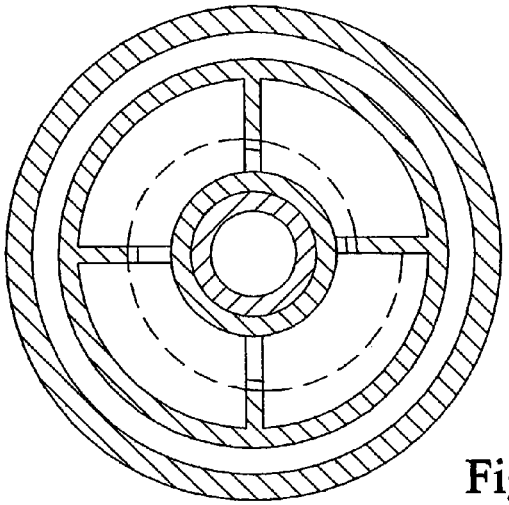
FIG. 7B is a sectioned top view taken along line 7B-7B in FIG. 7A.
Figure 7A:
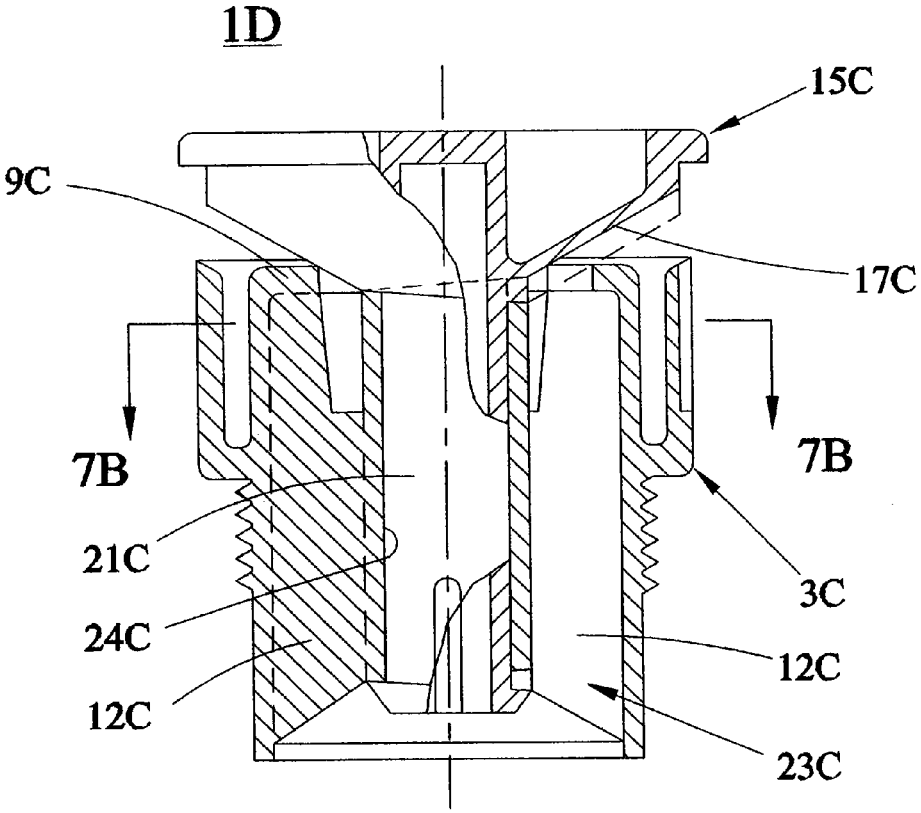
FIG. 7A is a side elevation view shown in section of a two piece adjustable arc of coverage spray nozzle which does not require a separate body insert element.

FIGS. 7A and 7B illustrate a two piece snap-together adjustable arc nozzle, generally denoted at 1D. The construction and operation is like that of the embodiment of FIGS. 1, 2A, and 2B, except that there is no separate body insert 23. Instead, the body insert 23D is molded into and is an integral part of the nozzle cylindrical housing 3D. The radial ribs 12D are also integral with housing 3D and extend all the way to the under side of the top surface 9D so that the latter is also stiffened by ribs 12D.

For this embodiment, flow control element 15D can be formed with co-molded flexible surface as in the embodiment of FIGS. 3 and 4, or can be snapped in place as in the embodiment of FIG. 5. The resulting flexibility of deflector plate 15D provides the tolerance accommodation for the arcuate valve single housing of FIG. 7.

FIGS. 8 and 8B, and 9A and 9B illustrate a sprinkler having a fixed arc of coverage (for example 180 degrees) with a spray range adjustable in discrete steps. This nozzle, generally denoted at 1E, includes a nozzle body 110 having a lower skirt portion 104 externally threaded at 106 for attachment to a sprinkler water supply, and a flow control element 100 having a flexible deflector plate 17E, located on the top of body 110. As described below, adjustment of the spray range is accomplished by changing the deflection angle of deflector plate 17E, and also adjustment of the flow through a water inlet orifice 122 to provide approximately the same precipitation rate for each of the selectable spray ranges.

A body insert 108 is press fitted into the bottom of skirt portion 104 to provide a secondary upstream flow control valve 180 to allow changing the factory-set precipitation rate. The upper portion of body member 110 has an annular passage 111 which communicates with a cavity area 112 formed by insert 108.

For this purpose an orifice disc 120 is provided with separate fixed orifices such as 121 and 122 for each range setting. This is snap fitted at 125 onto a shaft 126. Above disc 120, shaft 126 has a spiraled high pitch thread 127 which engages with an internally threaded tube 128 extending axially downward in flow control element 102 from the lower end of deflector plate 17E.

At the top of nozzle 1E, shaft 126 projects through an opening 143 in a plate 141, which together with a second plate 160, forms the top of deflector element 17E. Opposed vertical ribs 140 are provided to rotate plate 141 and shaft 126 to select the desired nozzle spray range. The available selected spray ranges may be indicated on the nozzle top plate 160 by arrow 142 and indices 145.

Figure 9B:
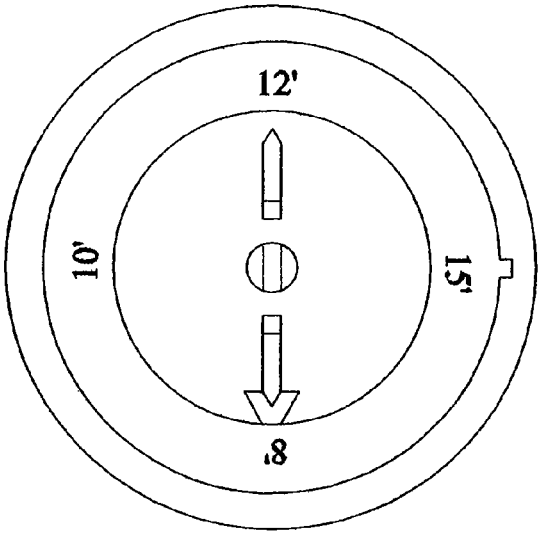
FIG. 9B is a top view corresponding to the setting shown in FIG. 9A.
Figure 9A:
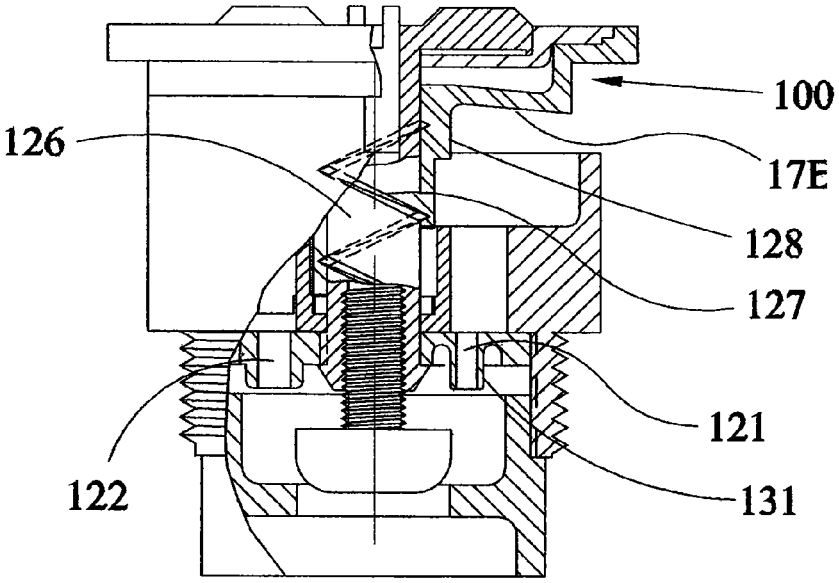
FIG. 9A is a side elevation view of the fix arc of coverage spray nozzle of FIGS. 8A and 8B shown in partial section in a short range low spray angle setting.

Top plate 160 is fixed against rotation by lug 161 so that the outside circumference is rotationally held in position as tube 126 is rotated. As illustrated in FIGS. 9A and 9B, when plate 141 is rotated counterclockwise by vertical ribs 140, the thread 127 on shaft 126 lifts tube 128, and the angle of deflector plate 17E relative to the horizontal is progressively reduced. This reduces the spray angle, and consequently, the spray range. Similarly, clockwise rotation causes tube 128 to be lowered, and the angle of deflector plate 17E relative to the horizontal is increased.

Figure 8B:
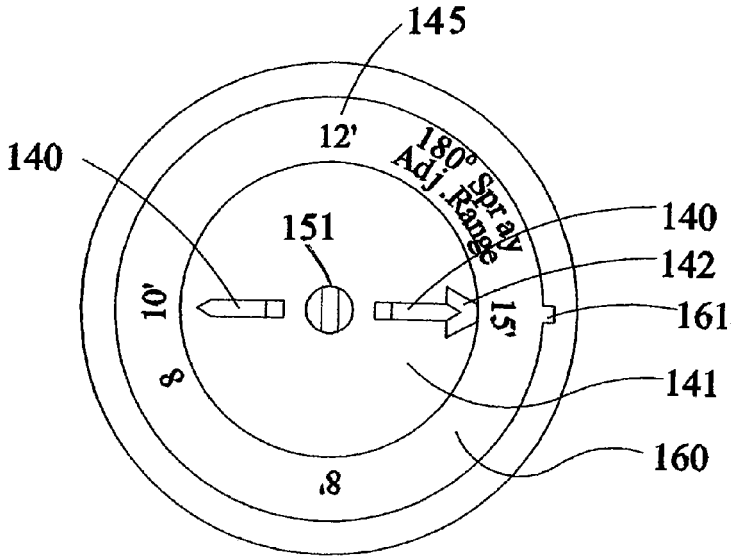
FIG. 8B is a top view of the sprinkler nozzle showing the nozzle range selection identification around the top and the selection rotatable pointer.
Figure 8A:
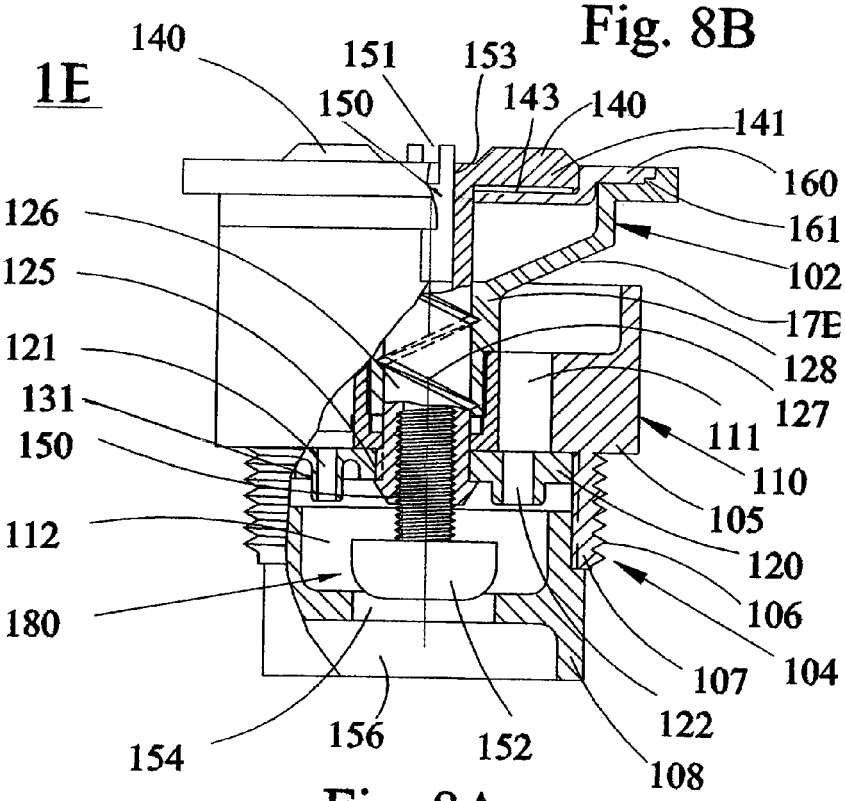
FIG. 8A is a side elevation view of a fixed arc of coverage spray nozzle shown in partial section with a flexible adjustable spray elevation angle deflector and having a matching flow orifice disk for each discrete range.

As illustrated in FIGS. 8A and 9A, flow orifice 121 has a thin wall 131 compared to flow orifice 122. This provides flow pressure compensation for higher pressures. The tube wall is sized so that it collapses as the pressure is raised to reduce the cross-sectional area of the passage. This helps to maintain the desired low flow rate.

Independent adjustment of upstream flow control valve 180 is also possible. For this purpose, screw 150 which is threaded into tube 128 and extends upwardly through a central opening 153 in top plate 141. A slot 151 is provided at the end of screw 150 to permit insertion of a screwdriver or the like.

The bottom of screw 150 terminates in a head 152. This cooperates with a bore 154 in the bottom of body insert 108 to form valve 180. As will be understood, the axial position of screw head 152 relative to bore 154 determines the flow area through valve 180 for water entering the sprinkler at inlet 156.

While we have illustrated and described the invention in terms of specific embodiments, it is to be understood that numerous changes and modifications will be apparent to those skilled in the art and may be made without departing from the spirit and scope of the invention. It is intended therefore, that the present invention be limited not by the specific disclosure herein, but only by the appended claims.

What is claimed is:

1. A spray nozzle assembly for an irrigation system comprising:

a housing having an inlet opening for attachment to a source of pressurized water and an outlet opening for emitting a stream of water; and a flow control element mounted in the housing that cooperates with the outlet opening to define an emission pattern for the stream of water, wherein the flow control element includes a resilient retaining portion which cooperates with a complementary element inside the housing to retain the flow control element in place inside the housing, but is resiliently releasable from the complementary element to allow removal of the flow control element from the housing, a portion of the flow control element which cooperates with the outlet opening includes a sloping surface inwardly tapered toward an upstream end of the nozzle assembly to deflect the stream of water as it exits the opening, whereby a water stream exit angle, and a spray range for the nozzle assembly are determined by the taper angle of the flow control element and further including an adjustment mechanism for manually changing the taper angle, and the portion of the flow control element which cooperates with the outlet opening is formed of a resilient body, and the adjustment mechanism is comprised of a member which is adjustable to apply a force to the resilient body to deform it to vary the taper angle.

2. A spray nozzle assembly according to claim 1, wherein the resilient retaining portion includes a lip extending radially outward, and the complementary element comprises a shoulder extending radially inward, the lip and the shoulder being configured and positioned such that the flow control element is restrained against axial movement in the downstream direction resulting from the force of water flowing through the housing.

3. A spray nozzle assembly according to claim 2, further including a relieved portion on the flow control element which allows radially inward movement of the lip to disengage it from the shoulder for removal of the flow control element.

4. A spray nozzle assembly according to claim 3, wherein the relieved portion is comprised of an axial slot, the upstream end of which forms a gap in the periphery of the lip, and extends in the downstream direction from the lip to allow the lip to be compressed out of engagement with the shoulder.

5. A spray nozzle assembly according to claim 4, wherein the geometry of the sloping surface and the outlet opening are selected to provide a desired height for the outlet opening, thereby determining an outlet flow area.

6. A spray nozzle assembly according to claim 1, wherein the flow control element and the outlet opening include cooperating spiral surfaces, the flow control element being rotatable relative to the outlet opening to define the peripheral extent of the opening, and thereby to determine the arc of coverage of the nozzle assembly.

7. A spray nozzle assembly for an irrigation system comprising:

a housing having an inlet opening for attachment to a source of pressurized water and an outlet opening for emitting a stream of water; and a flow control element mounted in the housing that cooperates with the outlet opening to define an emission pattern for the stream of water, wherein the flow control element includes a resilient retaining portion which cooperates with a complementary element inside the housing to retain the flow control element in place inside the housing, but is resiliently releasible from the complementary element to allow removal of the flow control element from the housing;

a portion of the flow control element which cooperates with the outlet opening includes a sloping surface inwardly tapered toward an upstream end of the nozzle assembly to deflect the stream of water as it exits the opening, whereby a water stream exit angle, and a spray range for the nozzle assembly are determined by the taper angle of the flow control element and further including an adjustment mechanism for manually changing the taper angle, the flow control element and the outlet opening include cooperating spiral surfaces, the flow control element being rotatable relative to the outlet opening to define the peripheral extent of the opening, and thereby to determine an arc of coverage of the nozzle assembly, the spiral surface of the flow control element is inwardly tapered toward an upstream end of the nozzle assembly to deflect the stream of water as it exits the opening, whereby a water stream exit angle, and a spray range for the nozzle assembly are determined by the shape of the flow control element installed therein, and the portion of the flow control element which cooperates with the outlet opening is formed of a resilient body, and the adjustment mechanism is comprised of a member which is adjustable to apply a force to the resilient body to deform it to vary the taper angle.

8. A spray nozzle assembly according to claim 7, wherein the spray range is determined by installation of a flow control element having a desired taper angle.

9. A spray nozzle assembly for an irrigation system comprising:

a housing having an inlet opening for attachment to a source of pressurized water and an outlet opening for emitting a stream of water; and a flow control element mounted in the housing that cooperates with the outlet opening to define an emission pattern for the stream of water, a portion of the flow control element which cooperates with the outlet opening includes a sloping surface inwardly tapered toward an upstream end of the nozzle assembly to deflect the stream of water as it exits the opening, whereby a water stream exit angle, and a spray range for the nozzle assembly are determined by the taper angle of the flow control element and further including an adjustment mechanism for manually changing the taper angle, the flow control element and the outlet opening include cooperating spiral surfaces, the flow control element being rotatable relative to the outlet opening to define the peripheral extent of the opening, and thereby to determine an arc of coverage of the nozzle assembly, the spiral surface of the flow control element is inwardly tapered toward an upstream end of the nozzle assembly to deflect the stream of water as it exits the opening, whereby a water stream exit angle, and a spray range for the nozzle assembly are determined by the shape of the flow control element installed therein, and the portion of the flow control element which cooperates with the outlet opening is formed of a resilient body, and the adjustment mechanism is comprised of a member which is adjustable to apply a force to the resilient body to deform it to vary the taper angle.

* * * * *